US005951208A

United States Patent [19]

Wilson et al.

[11] Patent Number: 5,951,208

[45] Date of Patent: Sep. 14, 1999

[54] ROOF BOLTING METHOD AND RELATED APPARATUS

[75] Inventors: Henry E. Wilson; William B. Schwab, both of Ironton, Ohio

[73] Assignee: J. H. Fletcher & Co., Inc., Huntington, W. Va.

[21] Appl. No.: 08/874,707

[22] Filed: Jun. 13, 1997

[51] Int. Cl.[6] ..... E21D 20/02; E21D 21/00

[52] U.S. Cl. ..... 405/259.6; 405/303

[58] Field of Search ..... 405/259.6, 303; 29/225, 227, 228, 561, 808, 809

[56] References Cited

U.S. PATENT DOCUMENTS

| | | | |
|---|---|---|---|
| 4,215,953 | 8/1980 | Perraud | 405/303 |
| 4,226,559 | 10/1980 | Prebensen | 405/303 |
| 4,229,124 | 10/1980 | Frey et al. | 405/303 |
| 4,398,850 | 8/1983 | Talvensaari | 405/259.6 |
| 4,420,277 | 12/1983 | Hibbard et al. | 405/259.5 |
| 4,473,325 | 9/1984 | Beney et al. | 405/303 |
| 4,576,525 | 3/1986 | Issakainen et al. | 405/269 |
| 4,588,037 | 5/1986 | Combet | 175/220 |
| 4,708,533 | 11/1987 | Leppänen | 405/303 |
| 4,832,536 | 5/1989 | Spross et al. | 405/303 |
| 4,979,848 | 12/1990 | Sauer | 405/259.5 |
| 5,114,279 | 5/1992 | Bjerngren et al. | 405/303 |
| 5,165,825 | 11/1992 | Wallin | 405/303 |
| 5,417,521 | 5/1995 | Scott | 405/259.6 |
| 5,494,380 | 2/1996 | Morrison et al. | 405/269 |
| 5,560,740 | 10/1996 | Castle et al. | 405/259.6 |

*Primary Examiner*—William Neuder
*Assistant Examiner*—Tara L. Mayo
*Attorney, Agent, or Firm*—King and Schickli

[57] ABSTRACT

A method of roof/side wall roof bolting in-situ includes the steps of drilling a bore hole, loading a rupturable resin cartridge into a lightweight, tubular wand through the delivery end, manually placing the wand with the delivery end adjacent the mouth of the bore hole, pushing the cartridge through the wand for transfer into the bore hole, and inserting the roof bolt to rupture the cartridge and for setting into place in the rock. The related apparatus includes a tubular wand, a flexible pusher that is extensible through the wand and into the bore hole for transfer of the cartridge and a driver in the form of a flexible snake assembly from a reel to push the cartridge. The snake assembly includes a cylindrical head on the end and a plastic retainer fits over the trailing end of the cartridge to prevent retro movement and to provide protection from premature rupture. A handle at the proximate end of the wand provides for easy manipulation of the wand.

10 Claims, 5 Drawing Sheets

33
32
21
T
M
41
40
31
30
21
20
23
32
33
B
23
35
B
36
35
36
36

ROOF BOLTING METHOD AND RELATED APPARATUS

TECHNICAL FIELD

The present invention relates to an improved system for installation of roof bolts in-situ, and more particularly, to a roof bolting method and related apparatus providing a simplified and more efficient approach for insertion of resin cartridges in the bore hole.

BACKGROUND OF THE INVENTION

Historically, the most widely used approach for installing a roof bolt in the roof or side wall of a mine included the use of an expandable nut on the end of the bolt to engage the side wall of the bore hole and hold the bolt in place. With the development of strong epoxy resins, mine operators began to use a resin cartridge in the distal end of the bore hole to provide additional holding force. As the roof bolt is pushed in the drilled hole and rotated during the installation process, the resin cartridge is ruptured and the catalyst mixes with the epoxy resin to form a hardened, permanent adhesive mass around the expandable nut and the adjacent bolt surface and anchoring against the inside surface of the hole.

In more recent years, as the epoxy resins have been further developed to make them stronger and provide for more rapid hardening, some roof bolt designs have eliminated the expandable nut on the end. Indeed, one of the most popular roof bolts today comprises simply a common reinforcing bar or rebar. The distal end of the rebar engages the resin cartridge in the distal end of the bore hole. As the proximate end of the rebar is engaged and rotated by a socket driven by a spinner, the cartridge ruptures mixing the catalyst with the resin. The mixture rapidly hardens to secure the roof bolt in place.

One area of continuing development with relation to the roof bolting method is the step of insertion of the resin cartridge into the bore hole. Originally, the operator of the roof bolting equipment worked from the mine floor inserting the resin cartridge into the bore hole by hand. In a relatively narrow coal seam mine, where the roof is low, this works reasonably well. However, as the seam thickness increases, and the roof moves up to the eight plus foot mark, the efficiency of the operation falls dramatically. In most instances a ladder is required, which means the process is slower, and much more physically demanding.

In attempts to alleviate these problems, inventors began to employ a hollow tube into which the resin cartridge was loaded; the tube being mounted with the drill on a turret, or on a similar carrier with a hydraulic lift. The cartridge is usually blown into the bore hole from the tube by water or air.

Development of the cartridge insertion technology within the last decade continues to focus on the use of different methods of using the pressurized fluid to drive the cartridge through a tube and into the bore hole. As far as we are aware, the tube is always mounted on a turret or the like supported by the roof bolter machine. For example, the Issakainen et al. U.S. Pat. No. 4,576,525 provides a side-by-side drill/tube, with the resin cartridge being inserted into the bore hole by pressurized fluid. In this apparatus, water is the preferred pressurized fluid that is used. However, the inventors recognize the need for additional driving force, as well as holding power, so that in addition they employ a separate slug of cement behind the cartridge after being inserted by the water injection step. A similar approach is taken in the patent to Wallin, U.S. Pat. No. 5,165,825. The advance in technology attempted in this later patent is to improve the mounting of the drill, the water injection tube, and the bolter on the turret. As will be realized, the proported advance in this machine is to further automate the procedure, but in reality the system is truly characterized by simply further complicating it. The expense of the water operated system, and the inherent mess that it causes is simply aggravated. The need for protective clothing for the operator appears to have been increased, thus leading to substantial discomfort for the operator. The maintenance and the fluid/material supply costs are greater. Due to need for multiple movements of the turret and its supporting boom, the power consumption is considerably increased.

Other approaches with regard to the common fluid injection systems for the resin cartridge simply offer the substitution of pressurized air for the water. Over the last decade these systems have also maintained their complicated and expensive nature, along with the increased expense of operation due to the need for large volumes of compressed air. For example, the Combet U.S. Pat. No. 4,588,037 provides such a system for turret mounting of the drill and the pneumatic injection of the resin cartridge.

The Morrison et al. U.S. Pat. No. 5,494,380 even further complicates the system by combining air and water in an attempt to provide more efficient resin cartridge delivery into the bore hole. The bottom line is that over time, and especially over the last decade, the prevailing consideration in the field is to provide more and more complicated and expensive fluid pressure systems in mostly failed experiments to improve the basic roof bolting method that uses epoxy resin for anchoring the roof bolt.

With the above trend toward complicating the method for installing roof bolts, and in particular the roof bolting method that uses epoxy resin to anchor the roof bolt, a need is now recognized for utilizing a different approach. Specifically, what we now envision as needed is a system of roof bolting, including inserting the resin cartridge into the bore hole, so as to uncomplicate the procedure. We especially see a need for reversing the escalating cost of the machines that heretofore focus on utilizing expensive turrets or the like, and wasteful pressurized fluid to push the cartridge into the bore hole. An approach is needed that is not only simpler, but more efficient for the operator of the roof bolter machine to use.

Accordingly, it is a primary object of the present invention to provide an improved in-situ roof/side wall bolting system, and related method/apparatus, where there is a departure from the prior art shortcomings of progressively complicated and more expensive, higher maintenance and operating cost attachments for the roof bolter machine.

It is another object of the present invention to provide a simplified and more efficient bolting system, method and related apparatus, wherein the resin cartridge for anchoring the roof bolt is mechanically pushed into the bore hole through a hollow, elongated wand that is manually operated.

It is still another object of the present invention to provide a simplified method/apparatus for a roof bolting system wherein the resin cartridge is manually loaded into the delivery end of a light weight wand that is capable of free and easy handling by the operator of the machine; the wand being manually placed in position adjacent the mouth of the bore hole and the cartridge mechanically pushed to the end in a reliable manner, and without the use of fluid being blown into the bore hole.

It is still another object of the present invention to provide a bolting system/method/apparatus and related resin cartridge insertion procedure, wherein a flexible, spring snake assembly with a driver, is mounted on a roof bolt machine to be utilized to push the resin cartridge through a manually manipulated hollow wand and into the bore hole for efficient and reliable positioning in the end of the bore hole to anchor the roof bolt.

Yet another object of the present invention is to provide such a roof bolting and resin cartridge insertion system that does not need a supply of fluid, either water or air, and provides improved and more efficient insertion of the resin cartridge into the bore hole for anchoring the roof bolt.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described, an improved method and related apparatus for installation of roof bolts in the roof or side wall of a mine comprises the steps of first drilling a bore hole, loading a resin cartridge in a hand held tubular wand, manually placing the wand with the delivery end adjacent the entrance orifice or mouth of the bore hole and pushing the cartridge through the wand for inserting it into the bore hole. Once the cartridge is in position in the bore hole, the roof bolt is placed in position and the resin cartridge is mixed by spinning the bolt. This action is operative to set the bolt securely in the rock. Utilizing this method, a simplified and more efficient operation for supporting the roof or side wall is possible. With this apparatus the operator's effective reach for manually inserting the resin cartridge in the bore hole is extended, minimizing the need for repositioning and thus allowing the operator to remain in the protected operator area. The complicated mechanical turrets that have dominated the operation in recent years, and the initial expense and attendant increased operating costs and maintenance is advantageously eliminated.

According to another feature of the present invention, the method can be most beneficially used with a roof bolting machine having an elevating boom that includes a drill head with a spinner and a drill guide; the guide being mounted at the forward end of the boom. According to the present invention, as the wand is manually placed in position for transfer of the resin cartridge into the bore hole, the end of the wand rests on the boom adjacent the drill guide. This provides the operator with assistance in the smooth and efficient transfer of the cartridge into the bore hole.

The best approach for loading the resin cartridge into the wand is performed simply by dropping the cartridge into the delivery end of the wand. The wand can be held in brackets, or supported by the operator during this step. This eliminates the need for opening and closing a side loading access into the wand and further simplifies the method and related apparatus.

To provide the movement of a cartridge without the use of either water or air pressure, an extensible flexible spring snake assembly is used. A driver, preferably in the form of a rotating reel, moves the spring axially along the wand behind the cartridge and into the bore hole. The spring for pushing the cartridge within the snake assembly is housed in a flexible sheath and includes a cylindrical head on the operative end that has a diameter substantially matching the inside of the wand and the bore hole. The head provides for a more efficient movement of the resin cartridge along its path through the wand and into the bore hole.

The wand with the snake assembly is light weight, and it includes a handle at its proximate end so that it can be easily manipulated and positioned by the operator. A retainer is positioned behind the cartridge in order to protect the cartridge from premature rupture as it is engaged by the head on the spring of the snake assembly. The retainer has trailing prongs providing a one-way stop as it moves into the hole, thus preventing retro-movement of the cartridge once it is in place.

The related apparatus for use with the roof bolting machine includes the tubular wand that is manually loaded and placed with the delivery end adjacent the mouth/entrance orifice of the bore hole. The wand incorporates a flexible pusher, that is extensible through the wand and into the hole for transfer of the cartridge into the bore hole. A driver is mounted on the roof bolting machine and provides the motive force in order to move the pusher, as required. Preferably, the pusher comprises a spring in a sheath and a cylindrical head on the end of the spring for engagement with the cartridge. A handle on the proximate end of the tubular wand adjacent the connection with the pusher facilitates the manual manipulation of the wand. As a consequence, a simplified and more efficient operation for insertion of the resin cartridge in the bore hole for the roof bolting method of the present invention is provided.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrates several aspects of the present invention and together with the description serves to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
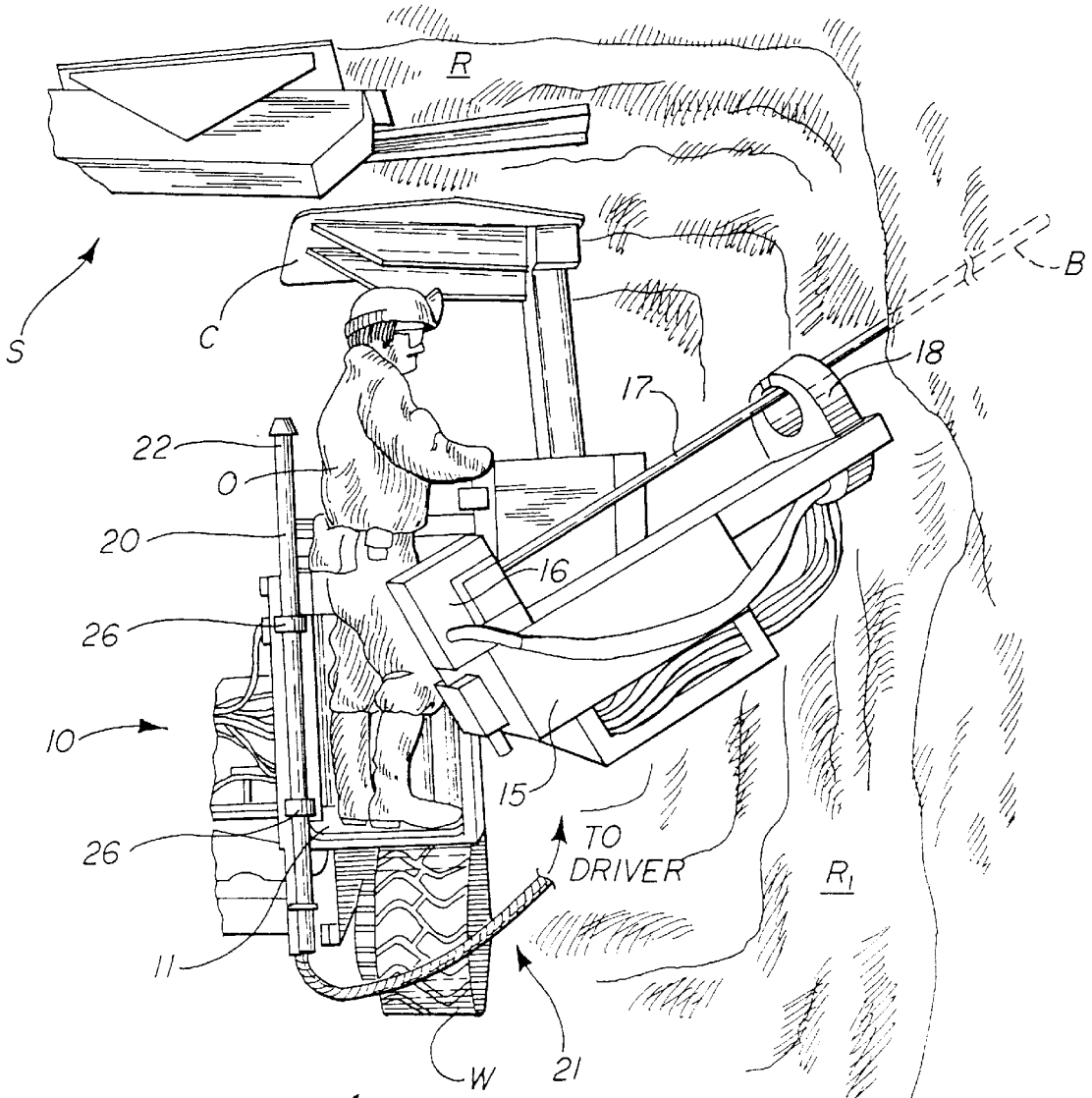
FIG. 1 is a perspective view illustrating a cut-away view of one side of a typical roof bolter machine with an elevating boom in the foreground and a drill steel and bit in position to perform the step of drilling a bore hole in a side wall of a mine passage.

With reference to FIG. 1 of the drawings, there is illustrated a standard roof bolter machine 10 (cut-away to save space) that is utilized in carrying out the method of the preferred embodiment of the invention. An operator O is illustrated standing on a platform 11 of the bolter machine 10 controlling the drilling operation. This particular representation is typical of one side of a dual head roof bolter machine, and is intended for illustrative purposes only. The particular representation provided will be recognized as a model HDDR of the J.H. Fletcher & Co. of Huntington, W.Va., the assignee of the present invention; although it is to be understood that within the concepts of the present invention any number of other suitable roof bolter machines can be employed.

In FIG. 1, the roof bolter machine 10 is illustrated as being typically mounted on a wheel or crawler W and has a protective canopy C positioned over the operator O. Furthermore, an automated temporary roof support (ATRS) is depicted in the illustration, generally represented by the reference indicia S. It is to be understood by those of skill in the art that the roof bolter machine is adapted to move along the mine passage defined by a roof R and a side wall $R_1$. It is operative to drill a bore hole B and install roof bolts either along the roof or either side wall $R_1$. In the dual head roof bolter 10 depicted, a second operator along the opposite side (not shown) performs the same operation as will be described. When other types of bolter machines are being used, the operator may even be positioned on the floor of the mine passage during the operation (not shown).

Figure 1A:
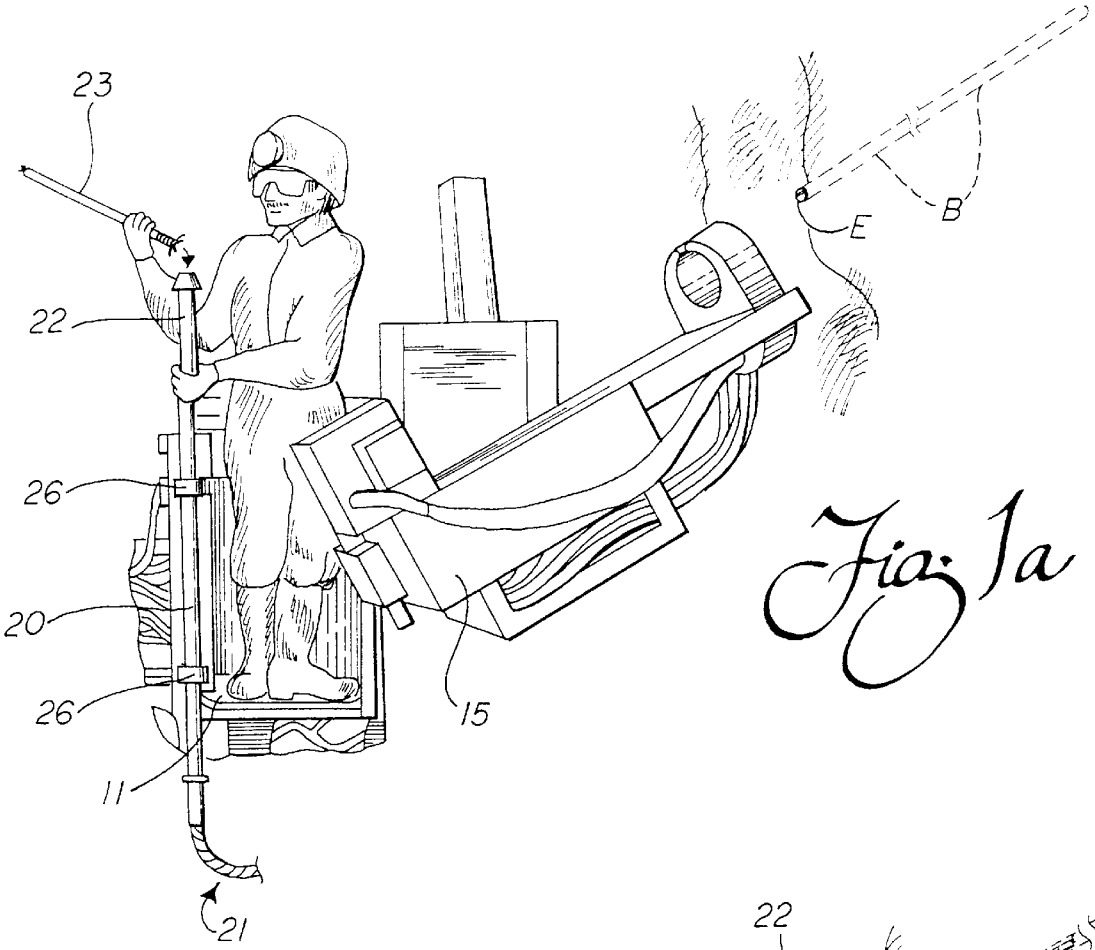
FIG. 1*a* is a perspective view with the second step of the method of the preferred embodiment of the invention being performed, that is loading the resin cartridge into the wand.
Figure 1B:
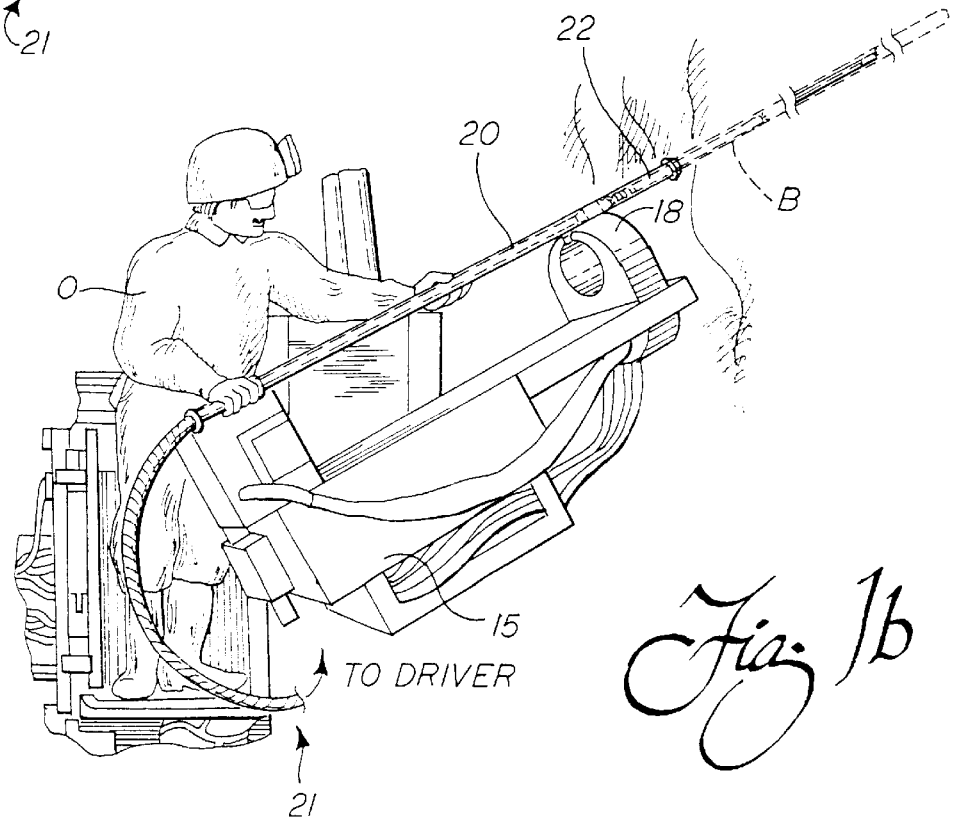
FIG. 1*b* is another perspective view similar to FIG. 1*a*, but with the step of manually placing the wand in position and pushing the cartridge into the bore hole according to the method.

With respect to all of the FIGS. 1, 1*a*, 1*b*, the preferred method of roof bolting in-situ includes drilling the bore hole B, as represented by the dashed line outline in these figures. To do this, the roof bolter machine 10 has an elevating boom 15 mounted in a typical fashion. On top of the boom 15 is a reciprocating drill head 16 with spinner that moves toward and away from the roof R/side wall $R_1$ to feed the drill steel and bit forward to form the bore hole B. To assist in the drilling operation, a drill guide 18 supports the drill steel and bit 17, as illustrated.

Once the bore hole B is completed by moving the elevating boom 15 into position and driving the drill head 16 toward the wall $R_1$, and assuming that the drill steel and bit 17 reaches the full programmed depth of the bore hole 15, the drill head 16 is moved in the opposite direction causing the drill steel and bit 17 to be fully retracted. The operator O then disengages the drill steel and bit from the drill head 16 and places it in storage tray T (see FIG. 2).

According to one of the primary innovative aspects of the present invention, the bolter machine 10 is provided with a hand held tubular wand 20. As illustrated in FIG. 1, the wand 20 is connected to the roof bolter 10 by a flexible snake assembly 21, and as will be further described below. The opposite end of the wand 20 represents a delivery end 22. The wand 20 is supported vertically, delivery end 22 in the up position next to the platform 11 in brackets 26 or similar cradle, for easy loading. The operator O is illustrating the manner of loading a resin cartridge 23 in the delivery end 22 of the wand 20 in FIG. 1*a*. Then, the operator lifts the wand 20 in a simple up and over fashion and places the delivery end 22 adjacent the entrance orifice or mouth E of the bore hole B. In doing so, he may elect to support the distal end of the wand 20 on the top of the closed drill guide 18.

Once the operator O has the delivery end 22 adjacent to and fitting with respect to the mouth E, the critical step of pushing the cartridge 23 through the wand 20 and transferring into the bore hole B takes place. Once the pushing or insertion step is completed, the operator simply returns the wand 20 back to the brackets/cradle 26 on the side of the platform 11. If the seam being mined is narrow, the height of the roof R may be insufficient to stow the wand vertically, in which case it is placed in an alternative brackets/cradle 26' on the side of the tray T (see FIG. 2). As will be realized, there is no need for a complicated turret, or other permanent mounting of a special cartridge inserter. The simple hand wand 30 is better. The elevating boom 15 remains in place as the cartridge 23 is inserted. It does not have to be operated to another position until it is moved to the next roof bolt location. As such, the design is simplified, the initial cost is reduced, and operating costs and maintenance are minimized. The operation is made very efficient all around allowing the operator to be in full control at all times.

Figure 2:
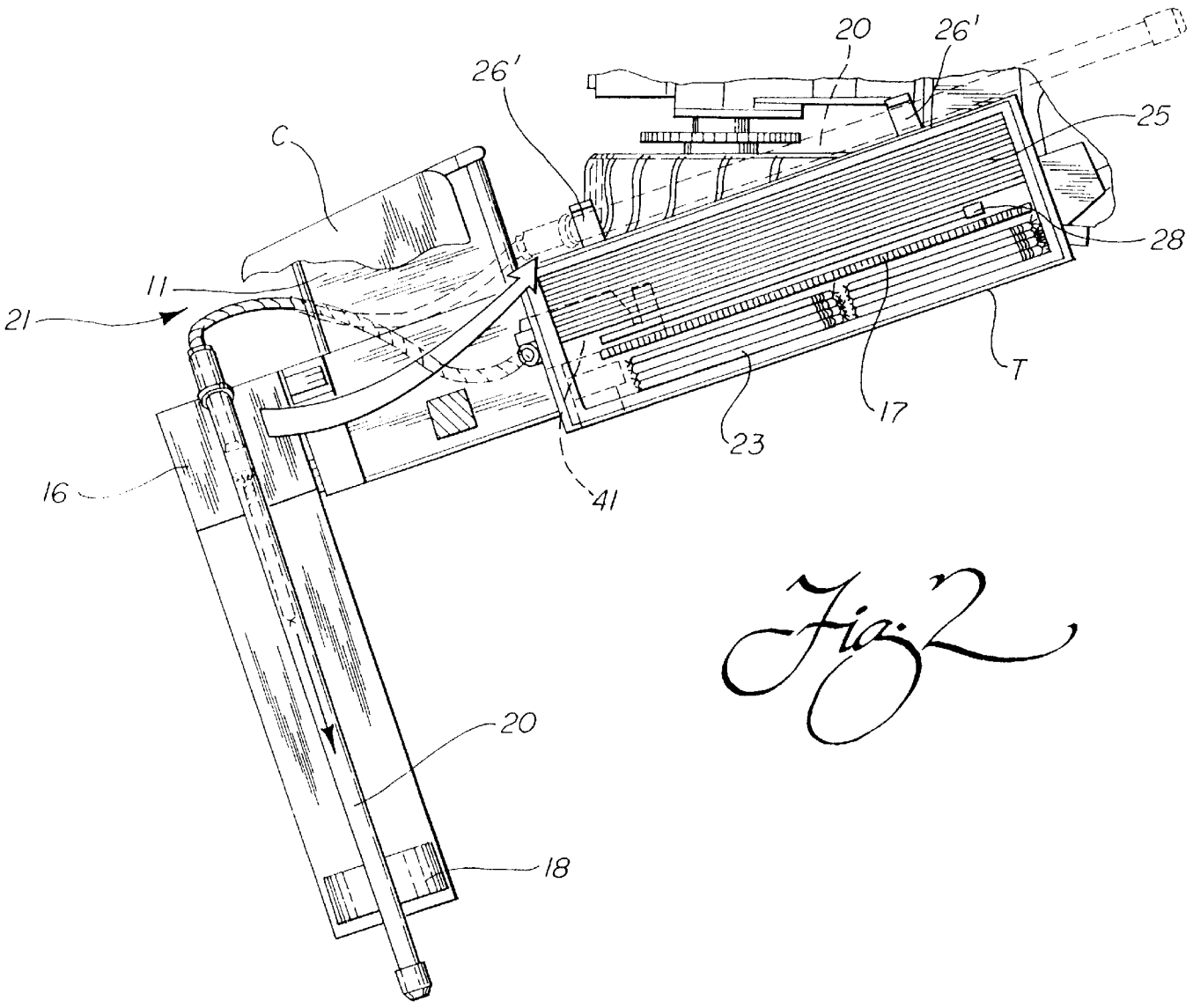
FIG. 2 is a top view in cut-away form of the same side of the roof bolter machine, illustrating the storage tray for the drill, resin cartridges, roof bolts, and socket wrench, as well as the adjacent operator platform and elevatable boom with the tubular wand in position for pushing the cartridge through the wand.

As illustrated in FIG. 2, the tray T for holding the drill steel and bit 17, also holds a supply of resin cartridges 23 positioned directly adjacent the operator's platform 11 in a convenient manner. The tray T also holds a supply of roof bolts 25, one bolt being inserted in each bore hole B and operated by spinning it with the spinner of the drill head 16. As illustrated, the elevating boom 15 is positioned adjacent and at substantially 90° to the tray T (see FIG. 2) providing easy access back-and-forth between the bolting components (drill steel and bit 17, resin cartridges 23, bolts and socket wrench 28) and the boom 15. Just as the operator can efficiently drill the bore hole B by manually placing the drill steel and bit 17 in the drill head 16 and the drill guide 18, we have discovered that with the wand 20 in such a readily accessible position for the operator O, the wand assisted, manual insertion of the resin cartridge 23 can be just as efficient and easily handled.

Figures 3, 3A, 3B, 3C:
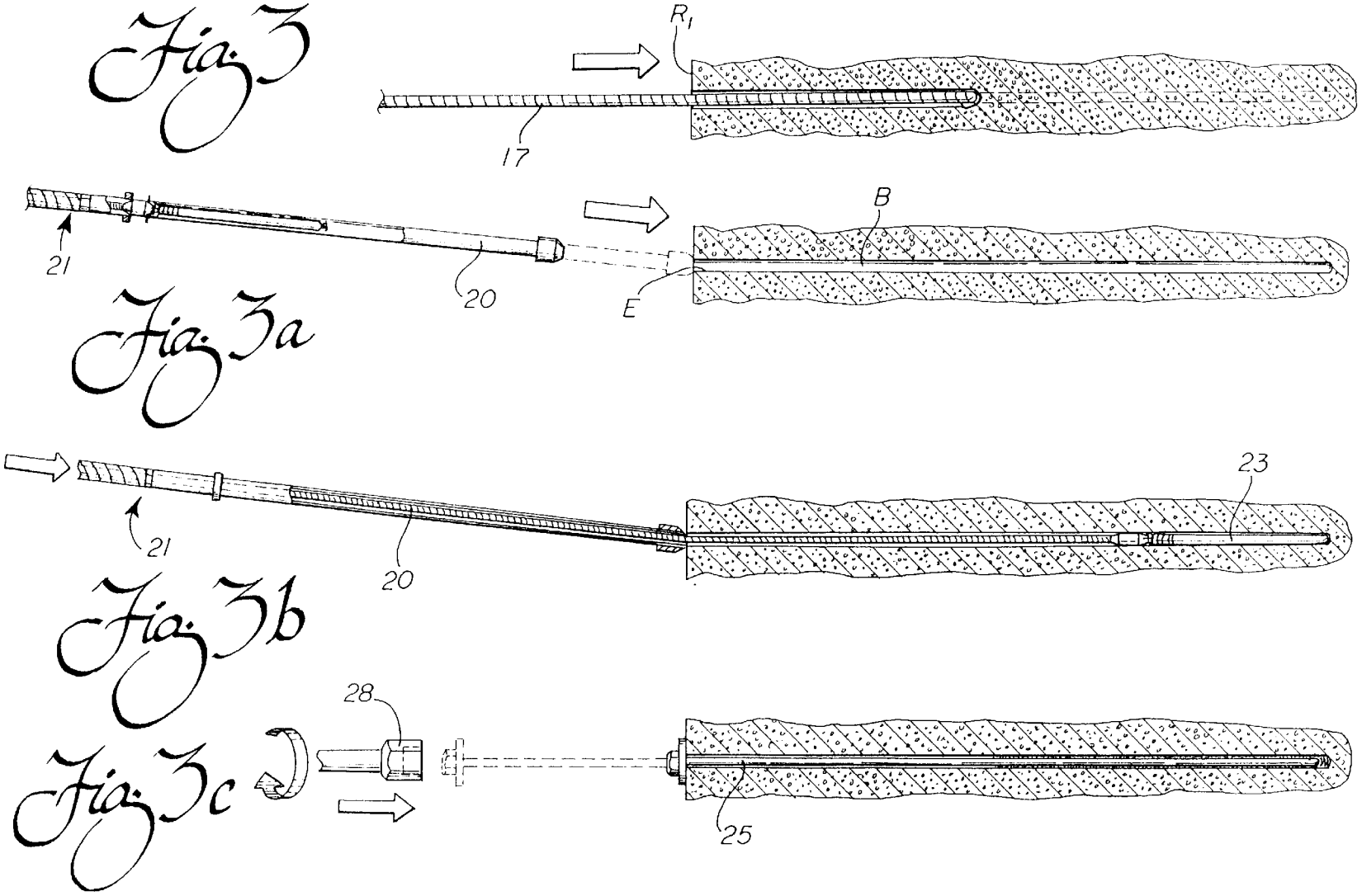
FIG. 3 is a schematic cut-away cross sectional view through the rock in which the anchoring is to take place with the drill steel and bit cutting through the rock.
FIG. 3*a* is a schematic cut-away view of the tubular wand being moved into position to the mouth of the bore hole, as formed in FIG. 3.
FIG. 3*b* is a schematic cut-away view similar to FIG. 3*a* but illustrating the manner in which the pusher has moved the resin cartridge and retainer into position in the bore hole.
FIG. 3*c* is a schematic cut-away illustration of the roof bolt in position in which the resin cartridge is ruptured and the resin and catalyst mixed to form a hardened anchor.

With reference now to the schematic views of FIGS. 3–3*c*, a more complete understanding of the operation of the present method of the invention can be understood. The drill steel and bit 17 is mounted in the drill head 16 (see also FIG. 1) and feeds forward into the side wall $R_1$ of rock. Once the operator O has finished drilling the full length of the hole (see dashed line position in FIG. 3 and full line in FIG. 3*a*) the drill steel and bit 17 is removed and placed on the tray T.

In the preferred embodiment illustrated, the roof R is relatively high making it possible to position the wand 20 upright at the end of the platform 11 in its own separate brackets 26 (see FIG. 1). Now, the operator O can easily load the resin cartridge 23 through the delivery end 22 of the wand 20, as illustrated in FIG. 1*a*. The wand 20 from this point can be simply raised up with minimum distance required and in a convenient manner, such as illustrated in FIG. 1*b*, for alignment with the mouth E of the bore hole B. Because of the convenience of positioning of the tray T and the ease with which the wand 20 can be loaded and placed in position for pushing the cartridge 23 into the hole B, the method of the present invention provides substantial advantages over the prior art devices. The alignment can most quickly and easily be made by the operator O resting the wand 20 on the drill guide 18. Since the hole B has just been drilled, and the boom 15 is not moved to minimize operating costs and the drill guide 18 is advantageously where it can assist most. There is no need for tedious mechanical positioning of a turret or the like, as in the prior art, which because of being subject to mechanical misalignment is sometimes problematic. Indeed, by being manually aligned, the wand 20 can be placed at a slight angle in any direction whenever conditions demand it (see FIGS. 3*a*, 3*b*).

Once in position with the mouth E of the completed bore hole B, the snake assembly 21 is activated, as illustrated in FIG. 3*b*. The cartridge 23 is smoothly transferred to the hole B and inserted into it in readiness to receive the end of the roof bolt 25. Thus, to complete the roof bolting method, a roof bolt 25, that includes a hex head or other driving device and a washer to spread the load, is installed. This is done in a typical fashion by the wrench 28, comprising a hex or square socket 28 on a shaft to be rotated by the spinner of the drill head 16. In other words, the socket 28 engages the bolt head and turns the roof bolt 25 as it moves from the dashed line to the full line position of FIG. 3*c*. As it does so, it mixes the catalyst with the resin in the cartridge 23, and upon hardening it provides the desired anchor for the roof bolt 25.

From the foregoing, it can be seen that the overall roof bolting operation of the present invention is very efficient. The basic roof bolting machine 10 that is common in the industry can be used. There is no need for adding expensive and maintenance prone turrets to be installed. The wand 20 is preferably fabricated of aluminum, or other light metal or rigid plastic, so that it can be easily manipulated by the operator O. It can be done rapidly, especially since the alignment can be performed in full view of the operator. The inventive method can be used for bolting in either the side wall $R_1$ as illustrated, or of course the roof R of the mine passage.

Figures 4, 4A, 5:
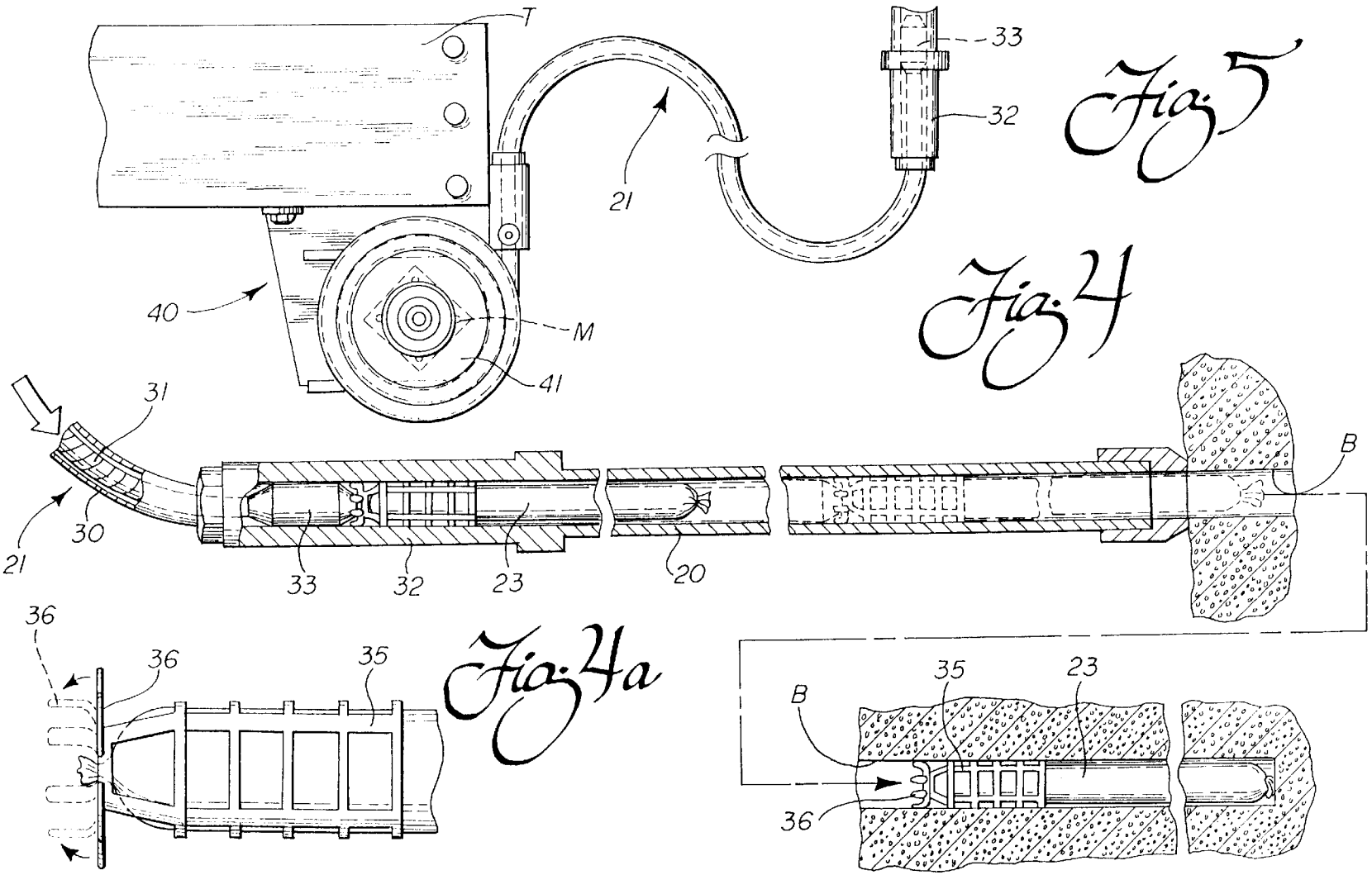
FIG. 4 is a schematic cut-away view, showing extension of the view along a dash-dot line, with the wand in cross section and illustrating the manner in which the resin cartridge and the retainer are positioned and pushed from the wand for transfer to and through the bore hole to the end.
FIG. 4*a* is an enlarged view of an example of a retainer that is interposed behind the cartridge and illustrating the manner of movement of the trailing prongs that serve as a one-way stop against retro-movement of the cartridge.
FIG. 5 is a schematic overview of a reel that serves as a driver for the spring of the snake assembly that is utilized to push the resin cartridge.

As illustrated in FIG. 5, the snake assembly 21 includes an outer sheath 30 and an inner flexible spring pusher 31 connected to the wand 20 at the proximal end. A handle 32 is provided for easy, one hand manipulation of the wand 20. The end of the spring 31 has an elongated cylindrical head 33 that approximates the inside bore diameter of the wand 20, and is slightly less than the bore hole B. As the spring 31 moves forward, the head 33 is guided in the wand to push the resin cartridge 23 in the direction of the bore hole, as shown between the full line and dashed line position in FIG. 5. In the extension of FIG. 5, the cartridge 23 is shown seated in the distal end of the bore hole B. Because the spring 30 and the head 33 are mechanical, and not fluid as in the prior art, this accurate positioning is assured each time. The operator does not have to wear extra protective clothing due to water spray and mist, such as is formed when fluid pushers are used.

The trailing end of the resin cartridge 23 may be provided with a retainer 35, as best shown in FIGS. 4 and 4*a*. The retainer is formed of plastic and surrounds the rear end of the cartridge 23. As the head 33 engages the trailing end, the retainer advantageously serves to rigidify and protect it from premature rupture. A plurality of prongs 36 extend rearwardly and outwardly (as shown by the action arrows and dashed line positions in FIG. 4*a*) as the cartridge is moved forward through the wand and transferred to the bore hole B. Because the prongs 36 extend in the trailing direction, once the cartridge 23 is within the hole B, the prongs act as a one way stop to prevent retro-movement. In other words, the springingness of the prongs 36 expand outwardly against the side walls of the bore hole B and provide resistance to movement back along the hole.

The snake assembly 21 is operated by a driver, generally designated by the reference numeral 40 in FIG. 5. The driver is conveniently mounted on the bottom of the tray T with the flexible snake assembly 21 thus being conveniently located just to the side of the platform 11 (see FIG. 2). The driver 40 can take any suitable form, such as a reel 41 driven by a hydraulic motor M, which is activated by the operator O in any conventional fashion, such as by a switch on the handle 32 or on the operating console of the machine 10. The reel 41 may include a spiral track that moves the spring 31 in and out of the driver 40 in a conventional fashion.

In summary, it will now be realized that substantial results and advantages are gained by the simplified and efficient roof bolting system, and the improved method and apparatus of the present invention. The tubular wand 20 is manipulated entirely by hand. It is free to be moved by the operator O unrestrained by turret mounting or the like. It is adaptive to efficiently insert the resin cartridge 23 in the bore hole B in the roof R or side wall $R_1$ from any location and from variable angles (FIGS. 3–3*b*). The wand 20 is easily loaded with the resin cartridge 23 through its delivery end 22 while stowed in the brackets 26 (FIG. 1*a*). In a simple upward motion it is moved to the position over the drill guide 18 for easy alignment with the mouth E of the bore hole B. The elevating boom 15 is not required to be operated until it is being moved to the next roof bolt location. The method is efficient since the operator's movement is minimized during loading of the cartridge 23, placing the wand 20 in position for pushing the cartridge 23 into the bore hole B and then returning the wand to the cradle 26, 26'. The use of the snake assembly 21 including the spring 20 is operative to rapidly push the cartridge 23 all the way to the distal end of the bore B. The trailing or proximal end of the cartridge is protected and is retained firmly in the bore hole B by the retainer 35.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

We claim:

1. A method of roof/side wall bolting for in-situ rock comprising the steps of:

drilling a bore hole;

loading a rupturable resin cartridge in a tubular wand having a delivery end;

manually placing the wand with the delivery end adjacent the entrance orifice of the bore hole;

pushing the cartridge from the delivery end of said wand through the orifice and into said bore hole; and inserting a roof bolt into said bore hole rupturing said cartridge and setting said roof bolt into place in said rock.

2. The bolting method of claim 1, wherein said steps of drilling and inserting/setting the roof bolt are performed by use of a roof bolting machine having an elevating boom with a drill head and guide; and said step of manually placing the wand is performed by moving the wand toward said orifice and resting the delivery end of the wand on the boom adjacent said guide for assisting in smooth transfer of the cartridge into the bore hole.

3. The bolting method of claim 2, wherein the wand rests on the drill guide of said boom.

4. The bolting method of claim 1, wherein the step of loading the resin cartridge in the wand is performed through the delivery end.

5. The bolting method of claim 4, wherein the step of pushing the cartridge into the bore hole is performed by extending a flexible spring into the wand behind said cartridge and axially moving said spring along said wand to push the cartridge toward the distal end of the bore hole.

6. The bolting method of claim 5, wherein the step of pushing the cartridge includes interposing a retainer having a one-way stop behind said cartridge to prevent retro-movement, whereby the cartridge is held in the bore hole once positioned therein.

7. The bolting method of claim 6, wherein is provided the step of surrounding the rear end of said cartridge by said retainer to provide protection against premature rupture.

8. The bolting method of claim 7, wherein the pushing step includes guiding a cylindrical head on an operative end of said spring engaging said retainer for added protection.

9. An apparatus adapted for use on a roof bolting machine for inserting a rupturable resin cartridge into a roof/side wall bore hole in rock drilled in-situ and for receiving a roof bolt comprising:

a tubular wand for manual placement of a delivery end adjacent the entrance orifice of said bore hole;

said wand being adapted to receive a resin cartridge;

a flexible pusher connected to the proximate end of said wand and extensible through said wand into said bore hole for transfer of said cartridge into position for anchoring a roof bolt; and a driver for said pusher mounted on said machine.

10. The resin cartridge inserting apparatus of claim 9, wherein said flexible pusher comprises a spring in a sheath;

a cylindrical head on the end of said spring for engagement behind said cartridge; and a handle on the proximate end of said tubular wand adjacent the connection with said pusher.

* * * * *